United States Patent [19]

Dunlop

[11] 3,933,077

[45] Jan. 20, 1976

[54] CONVERTER FOR GUITARS

[76] Inventor: James Dunlop, Bldg. 52, Benicia Industrial Park, Benicia, Calif. 94510

[22] Filed: Feb. 20, 1975

[21] Appl. No.: 551,093

[52] U.S. Cl. ..... 84/318
[51] Int. Cl.[2] ..... G10D 3/00
[58] Field of Search ..... 84/318, 264–266, 84/453

[56] References Cited

UNITED STATES PATENTS

| | | | |
|---|---|---|---|
| 370,172 | 9/1887 | Wood | 84/318 |
| 416,057 | 11/1889 | Gill et al. | 84/318 |
| 583,102 | 5/1897 | Utt | 84/318 |
| 1,788,636 | 1/1931 | Russell | 84/318 |

*Primary Examiner*—Lawrence R. Franklin
*Attorney, Agent, or Firm*—Kurt A. Tauchen

[57] ABSTRACT

A device for converting a conventional Spanish guitar into an instrument which can be played like a Hawaiian guitar. The device comprises a spacer member in the form of a rod of substantial thickness that is slipped underneath the strings of the guitar to raise them above the frets in the upper surface of the guitar neck, and rigidly attached to said spacer member is a pressure member likewise in the form of a rod provided with a cover of a resiliently yieldable material that is to engage the strings of the guitar from above to hold them against the spacer member; and detachable means are provided to secure the pressure member to the neck of the guitar. The same device may also be used as a capotasto on Hawaiian type guitars.

4 Claims, 6 Drawing Figures

CONVERTER FOR GUITARS

BACKGROUND OF THE INVENTION

The present invention relates to the type of stringed musical instrument known as guitars. On such instruments a plurality of strings extend in parallel juxtaposition along the upper surface of a long slender neck. These strings are plucked by the player with the fingers of one of his hands, and the different notes are established by pressure of the finger tips of his other hand against the strings at different points longitudinally thereof. There are different types of guitars; the most prevalent one is the Spanish guitar in which the upper surface of the neck is provided with many frets that extend transversely across the neck of the guitar and which are spaced from each other in a direction longitudinally of the neck. The strings in such guitars are arranged to extend slightly above these frets and the frets assist the player in locating the proper place for his fingers for establishing a certain note, which he does when he presses his finger or fingers against selected frets or against the upper surface of the neck of the guitar at a point slightly in front of a selected fret (i.e., in front as viewed in a direction looking toward the "bridge" of the guitar). Another type of guitar is the Hawaiian guitar. These guitars differ from the conventional Spanish guitars in that the strings are arranged to extend at such an altitude above the neck of the guitar that they cannot conveniently be brought into contact with the neck of the guitar by finger pressure on the player's part. Due to this difference the player may slide an implement know as "steel" longitudinally along the strings during play producing a peculiar sobbing sound effect that is typical for Hawaiian type music.

OBJECTS OF THE INVENTION

It is an object of the invention to provide an appliance for conventional type guitars, that converts such guitars into instruments on which Hawaiian type music be played and Hawaiian type sound effects may be obtained.

It is another object of the invention to provide such a converter appliance that is of simple and inexpensive construction and which may easily be applied to the neck of conventional guitars.

Hawaiian type guitars are difficult to provide with capotastos. Capotastos are clamp-like devices which are applied to the necks of stringed instruments, especially guitars, mandolinas and banjos to shorten the effective length of the strings. This makes it easier for players of limited experience to play higher keys since the same fingering may be used in the higher keys established by the capo as the basic key. In Hawaiian type guitars it is difficult to install a capotasto effectively because of the great vertical distance between the strings and the top surface of the neck, as it would require placing an excessive strain upon the strings to bring them into contact with the neck.

It is another object of my invention to provide a capotasto for use on Hawaiian type guitars.

SUMMARY OF THE INVENTION

The device of the invention has a combined spacer and support member for insertion underneath of the strings of the guitars to raise them above and out of contact with the frets in the guitar neck; and attached to it is a pressure member for application upon the strings to urge them into contact with the spacer member, and there is also means provided for detachably securing said pressure member under pressure to the neck of a guitar.

DETAILED DESCRIPTION OF CERTAIN PREFERRED EMBODIMENTS OF THE INVENTION

Figure 1:
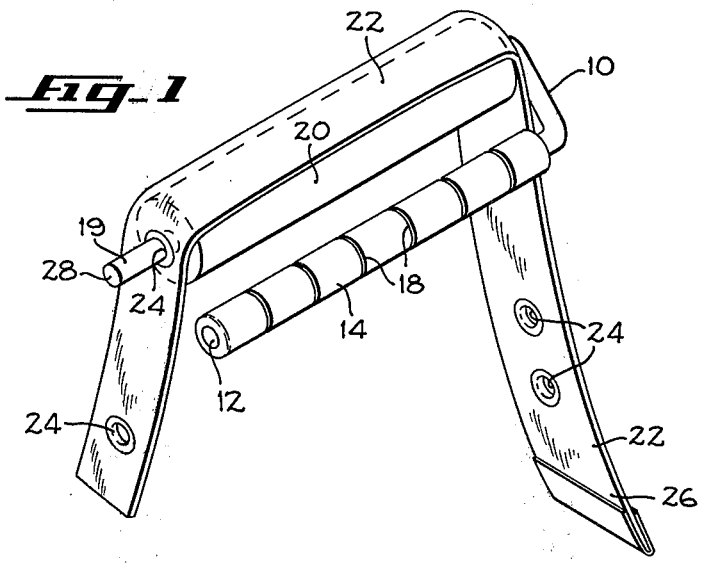
FIG. 1 is a perspective of an embodiment of the device of my invention.
Figure 2:
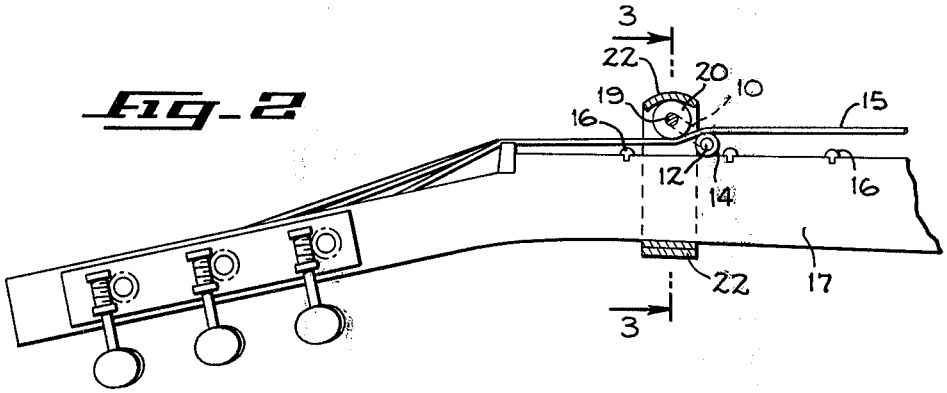
FIG. 2 is a fragmentary side elevation, partly in section of the neck of a conventional Spanish guitar to which the device of the invention has been applied to convert it into a Hawaiian guitar.

The device of the invention illustrated in FIG. 1 comprises a U-shaped carrier member 10 whose lower leg 12 carries a sleeve 14 to increase its thickness so that when slipped under the strings 15 of a Spanish guitar of conventional design (FIG. 2) it will raise these strings sufficiently high above the frets 16 in the neck 17 of the guitar to make it possible to play it in the manner of a Hawaiian guitar. For this purpose the leg 12 must be of a sufficiently large diameter or may carry the above mentioned sleeve 14 which is of sufficient diametrical thickness as shown in FIGS. 1 and 2. It may have a cylindrical outer surface but may also be of polygonal cross sectional contour as shown in FIG. 4. Its outer surface may be provided with grooves 18 for the reception of the strings. Sleeve 14 may be arranged to be replacable so that it can be exchanged for sleeves of different wall thickness to establish selectively different distances above the frets 16 depending upon the dimensions of the neck and the frets of a particular guitar. The other leg 19 of the carrier element 10 is provided with a thickwalled sleeve 20 of a resiliently yieldable material, such as rubber ro a suitable plastic, and means are provided to attach the pressure member 19/20 to the neck of the guitar in a position overlying the strings in such a manner that it urges them against the spacer member 12/14 and holds the whole device securely upon the neck of the guitar. For this purpose an elastic strap or band 22 provided with sutiably located holes 24 may be engaged over the upper leg 19 of the carrier member 10 at either side of sleeve 20 as shown in FIG. 3 and the free elongated end 26 of said strap is brought underneath and around the neck of the guitar and engaged over the free elongated end 28 of the upper leg 19 of the carrier member 10, as best shown in FIG. 3.

Figure 3:
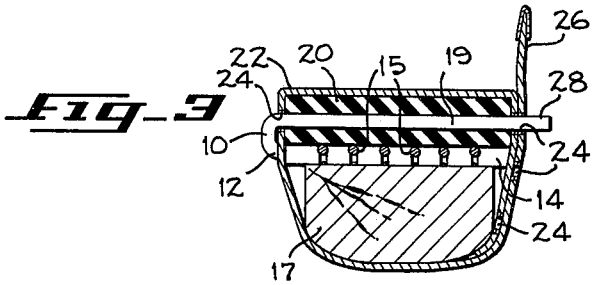
FIG. 3 is a section taken along line 3 — 3 of FIG. 2 and viewed in the direction of the arrows associated with said line.
Figure 4:
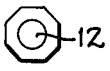

If the owner of a conventional Spanish guitar wishes to play his instrument in the manner of Hawaiian guitar, i.e. with the strings of the guitar out of contact with the frets in the neck of the guitar, he slips the spacer member 12/14 under the strings of the guitar above the top surface of the neck of the instrument as shown in FIGS. 2 and 3 which raises the strings markedly above the frets 16, making sure that the sleeve 20 of the pressure member 19 comes to rest upon the strings from the outside. He then pulls the free end 26 of the elastic band 22 underneath and around the neck of the guitar exerting some pull upon the band to elongate it, and he engages a suitable hole 24 in the respective end of the band over the free end 28 of carrier 19 of the pressure member, and releases both the pressure member and the free end of the band. The device of the invention is now securely tied to the neck of the guitar with the strings of the guitar raised out of contact with the frets on the keyboard of the guitar neck. The instrument may now be played in the manner of a Hawaiian guitar, with the player sliding a "steel" along the strings thus producing the peculiar sobbing sound for which Hawaiian guitars are renowned.

Figure 5:
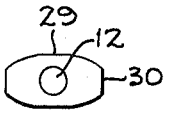
FIGS. 4 and 5 are end views of modified embodiments of the spacer member that forms part of the device of the invention.

To adjust the appliance of may invention to instruments of different design or dimensions, its spacer or support element 12/14 may be constructed to be of adjustably variable diammetrical dimension. For instance, the arrangement may be such that the sleeve 14 on the lower leg 12 of the carrier member 10 may be exchanged for sleeves of greater or lesser wall thickness, as has been pointed out hereinbefore. Alternatively, the sleeve may be of other than circular outer contour, such as shown in FIG. 5 where it is of elliptic outer contour with areas of its long and short sides flattened as indicated at 29 and 30, respectively. Hence, by turning a sleeve thus shaped on the lower leg 12 of the support member, the distance by which the device will raise the strings 15 above the neck of the guitar may be increased or decreased, as desired.

Figure 6:
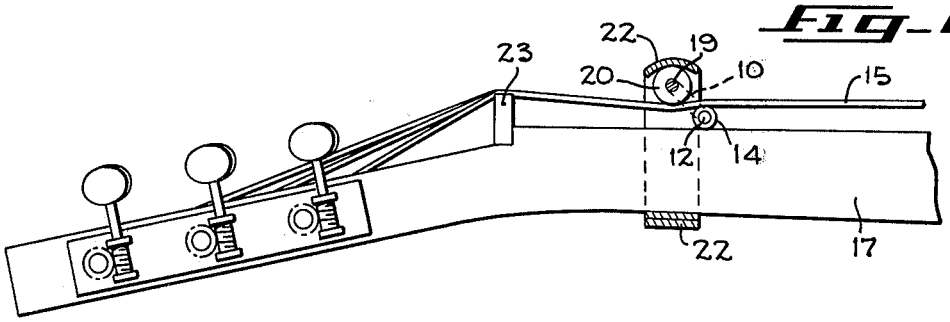
FIG. 6 is a fragmentary side elevation, partly in section of a Hawaiian guitar to which the device of my invention has been applied to act as a capotasto.

The device of the invention has an additional utility. It may be used on a Hawaiian guitar as a Capotasto. Usually it is difficult to apply a capotasto to a Hawaiian guitar due to the fact that the strings of a Hawaiian guitar are located rather high above the top surface of the neck of the guitar; and it would require a considerable amount of force and may envolve excessive stretching of the strings to bring the strings thus raised into contact with the neck of the instrument to render a capo effective. FIG. 6 illustrates the manner in which the device of the invention may act as a capotasto on a Hawaiian guitar. The reference numerals 12/14 identify again the spacer member which now acts merely as a support against which the pressure member 19/20 presses the strings 15 of the instrument, that are normally held in a higher position than in the Spanish type guitar due to the vertical depth of the nut 23. The means for attaching the device to the neck of the Hawaiian instrument are analogically the same as described in connection with its use as a converter.

I claim:

1. A converter for Spanish guitars comprising a spacer member for insertion underneath the strings of the guitar to raise and strings higher above the top surface of the neck of the guitar, said spacer member carrying rotatably mounted thereon a sleeve of elliptical cross-sectional contour, a pressure member supported from said spacer member for application over the strings of the guitar to urge them against said sleeve, and means for detachably securing said pressure member to the neck of the guitar.

2. A converter according to claim 1 wherein said rotatable sleeve of elliptical cross sectional contour has flattened areas in its outer surface.

3. A converter for Spanish type guitars comprising a U-shaped carrier member, a spacer member in the form of a sleeve rotatably mounted upon one of the legs of said carrier member for insertion underneath the strings of the guitar to raise said strings higher above the stop surface of the neck of the guitar, the outer surface of said sleeve being of elliptical cross-section, a pressure member of resiliently yieldable material mounted upon the other leg of said carrier member for application over the strings of said guitar, and means engaging the opposite ends of said last mentioned leg for securing it to the neck of the guitar.

4. A converter according to claim 3 wherein said sleeve of elliptical cross section sectional contour has flattened areas formed in its outer surface.

* * * * *